United States Patent [19]

Malzahn et al.

[11] Patent Number: 5,070,948

[45] Date of Patent: Dec. 10, 1991

[54] DIRECTIONAL ROD PUSHER

[75] Inventors: G. Edwin Malzahn; Kenneth W. Schuermann, both of Perry, Okla.

[73] Assignee: The Charles Machine Works, Inc., Perry, Okla.

[21] Appl. No.: 560,565

[22] Filed: Jul. 31, 1990

Related U.S. Application Data

[63] Continuation-in-part of Ser. No. 333,678, Apr. 6, 1989, Pat. No. 4,945,999.

[51] Int. Cl.[5] ..... E21B 4/06; E21B 7/06; E21B 7/26; E21B 44/00

[52] U.S. Cl. ..... 175/19; 175/61

[58] Field of Search ..... 175/19, 61, 62, 73, 175/74, 75; 173/35; 74/99 R

[56] References Cited

U.S. PATENT DOCUMENTS

| | | | |
|---|---|---|---|
| 3,529,682 | 9/1970 | Coyne et al. . | |
| 3,589,454 | 6/1971 | Coyne | 175/26 |
| 4,271,711 | 6/1981 | Vavra | 74/96 |
| 4,304,142 | 12/1981 | Blomstrom | 74/105 |
| 4,306,626 | 12/1981 | Duke et al. | 173/35 |
| 4,621,698 | 11/1986 | Pittard et al. | 175/19 X |
| 4,632,191 | 12/1986 | McDonald et al. | 175/19 |
| 4,694,913 | 9/1987 | McDonald et al. | 175/61 |
| 4,834,193 | 5/1989 | Leitko, Jr. et al. | 175/19 |
| 4,938,297 | 7/1990 | Schmidt | 175/19 |
| 4,945,999 | 8/1990 | Malzahn | 175/19 |

OTHER PUBLICATIONS

The publication entitled "P40 and P80 Rod Pushers," dated Mar. 1990, by the Charles Machine Works.

The publication entitled "True Trac Extended-Range Guided Boring System" dated Mar. 1990, by the Charles Machine Works.

The publication entitled "The Hole Boring Story" dated Oct. 1989, by the Charles Machine Works.

*Primary Examiner*—William P. Neuder

*Attorney, Agent, or Firm*—Banner, Birch, McKie & Beckett

[57] ABSTRACT

The present invention comprises a rod pusher device which moves a drill string having a directional boring bit at its leading end. The invention includes a conversion device to automatically and simultaneously convert the axial movement of the drill string into a combined axial and rotational movement of the drill string. The conversion device is selectively engageable so that the push rod operator can readily select between axial movement of the drill string or combined axial and rotational movement, and thereby control the path of the borehole.

33 Claims, 7 Drawing Sheets

DIRECTIONAL ROD PUSHER

BACKGROUND OF THE INVENTION

Related Applications

This application is a continuation-in-part of Ser. No. 333,678, filed on Apr. 6, 1989, and issued on Aug. 7, 1990, as U.S. Pat. No. 4,945,999.

DESCRIPTION OF THE PRIOR ART

This invention relates to drilling an underground borehole for installing underground utility lines without excavating a trench. More particularly, the invention relates to a directional rod pusher for moving a string of push rods through the earth to form the borehole. Specifically, the invention relates to an improved directional rod pusher wherein rotational movement of the push rod may be automatically and simultaneously effected upon axial movement of the push rod.

The benefits of trenchless digging for installing underground utility lines are well-known, as disclosed, for example, in U.S. Pat. Nos. 4,306,626 and 4,694,913. A number of different types of devices are available for the purpose of installing underground utility services without cutting an open trench. These include percussion boring tools, rotary boring tools, push rod boring systems, and earth augers. The present invention relates to a push rod boring system. Each of these different types of underground boring devices has a specific purpose and specific operating characteristics. Their use depends on the type of soil in which the borehole will be formed, the length and diameter of the borehole, conditions at the job site, and a number of other factors.

In a typical percussion boring tool, an internal striker or hammer is reciprocated against an anvil or tip to propel the tool through the soil. These tools pierce and compact compressible soils as they form the borehole. A typical percussion boring tool is shown, for example, in U.S. Pat. Nos. 4,621,698, and 4,632,191.

Rotary boring tools use a rotatable "mole" or boring bit to drill through the earth. The mole may be rotated by a downhole motor adjacent the mole or by a surface based drive system. U.S. Pat. Nos. 3,529,682 and 3,589,454 disclose a rotary mole in combination with a complex mole tracking system.

Earth augers are large, powerful screw-type drills for digging horizontal boreholes. These devices are used primarily for digging large diameter boreholes or digging in difficult soil conditions.

A rod pusher is a relatively simple, compact device for sequentially thrusting an increasing string of "push rods" through the ground from a small subsurface starting pit. Such a device can easily be set up and made operational within an hour or two, including excavation of the starting pit. Usually the push rod uses a drill bit having a cutting tip fixed to its leading end. Successive lengths of push rod are pieced together to form a drill string, which forms the borehole. A push rod boring system is disclosed, for example, in U.S. Pat. Nos. 4,306,626 and 4,694,913.

In recent years, new techniques have been developed to allow tracking the progress (i.e., location and depth) of the various types of underground boring devices. Also, there have been various means developed to correct the path of the borehole as the tool progresses, if it begins to deviate from the desired path because of changing soil conditions, rocks, or other obstructions.

In particular, McDonald, U.S. Pat. No. 4,694,913, discloses a rod pusher device having directional control. The directional control is achieved by using a drill bit having an angled or beveled face. As the drill string is pushed through the soil without rotation, the resultant soil forces on the drill bit act at an angle to the centerline of the borehole and string of rods. The perpendicular component of this resultant force tends to cause the head to deviate from its course along a curved path as the string of rods continues to be advanced axially. As long as the beveled face of the drill is maintained in this same orientation, the path of the drill string will follow a continuous curve. An essentially straight borehole can be formed by rotating the beveled drill bit as it is advanced through the soil. When a steering correction is desired, the rotation is stopped with the drill bit oriented to cause deviation of the drill bit back to the desired path. Electronic tracking means known in the art are used to determine the need for path corrections and to indicate the drill bit orientation and thus the orientation of the beveled face.

In order to achieve the rotational motion necessary for directional control of a rod pusher device, McDonald uses a broadly disclosed motor and control assembly which provides either axial movement to the drill string or combined axial and rotational movement. This device requires, however, a complex and expensive control mechanism.

Duke, U.S. Pat. No. 4,306,626 discloses a basic rod pusher device without direction control. It is a very economical directional boring system. This rod pusher device incrementally advances push rods into a bore by gripping the rod with a jaw mechanism that is thrust forward by a hydraulic cylinder. At the end of each cylinder stroke, the jaws are released from the rod and the cylinder is retracted for the next pushing increment. Additional rods are added to the back end of the drill string as needed.

A device such as disclosed in Duke may be made steerable by using a beveled face drill bit attached to the leading end of the string of push rods. However, the simple and economical Duke rod pusher does not have any means for imparting rotary motion to the drill bit. Thus, when a directional boring head is used with this rod pusher, the string of rods must be rotated manually by the crew through use of a pipe wrench or by pushing on the jaw handle. This is a tedious and tiring operation.

The present invention is a simple yet effective means to provide directional control and steering capabilities for rod pusher devices. The invention automatically and simultaneously causes rotational movement of the drill string upon axial movement of the drill string. The invention is used in the context of a simple rod pusher which only has drive means for imparting axial movement to a drill string and does not have any motors or other power sources for causing rotational movement to a drill string.

SUMMARY OF THE INVENTION

In its preferred form, the present invention is used in conjunction with a rod pusher device such as disclosed in Duke, U.S. Pat. No. 4,306,626, in which a coupling or gripping assembly couples a hydraulic thrust cylinder to a drill string so that the drill string is moved axially by the thrust cylinder. It will be readily apparent, however, that the invention is not limited to the specific structure of the preferred embodiment.

The present invention comprises a rod pusher device which moves a drill string having a directional boring bit at its leading end. The invention includes a conversion device, such as a rigid link, mounted between a fixed point, such as on the hydraulic thrust cylinder or frame assembly, and a moveable point, such as on the moveable coupling assembly, to automatically and simultaneously convert the axial movement of the thrust cylinder and drill string into a combined axial and rotational movement of the drill string. The link is removable so that the push rod operator can readily select between axial movement of the drill string or combined axial and rotational movement, and thereby control the path of the borehole.

In an additional preferred embodiment, the conversion device comprises a guide disposed between the side walls of the frame and including a pathway formed therethrough. A cam follower is disposed on the coupling assembly. The follower is forced to traverse the pathway during axial movement of the coupling assembly such that the follower and assembly undergo rotational movement in addition to the axial movement. In a further preferred embodiment, the conversion device comprises a cable fixed at either end to the frame side walls and coupled at an intermediary point to a pin disposed on the coupling assembly. The cable forces the pin and thus the coupling assembly to undergo rotational motion simultaneously with axial motion. Alternatively, the cable could be replaced by two separate cables each linked at one end to the side walls and at the other end to the coupling assembly.

The present invention provides a passive, self-generated means of rotating the coupling assembly as the rod pusher hydraulic cylinder advances the coupling assembly and thus the string of push rods gripped by the coupling assembly. The grip of the coupling assembly onto the rod must by design be sufficient to overcome soil resistance against the drill string as it forms the borehole. This grip is also sufficient to transmit a rotational force to the drill string.

DETAILED DESCRIPTION OF THE PREFERRED EMBODIMENTS

Figure 1:
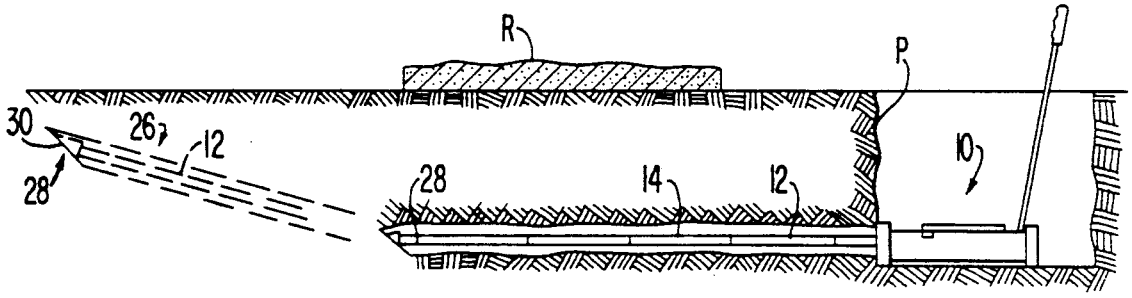
FIG. 1 is a schematic drawing, partially in section, of a push rod boring system according to the present invention.

A push rod boring system 10 is shown generally in FIG. 1. Boring system 10 is shown positioned in a launching pit P. However, boring system 10 may also be positioned directly on the surface and enter the earth at an angle to the surface. Boring system 10 may be directed to a target pit or may be directed towards a surface target.

Boring system 10 is positioned to dig a borehole under a surface obstacle, such as a roadway R, by pushing a drill string 12 through the earth. Drill string 12 is made up of a plurality of push rods 14, which are connected together to make a borehole of the desired length. Push rods 14 are typically solid steel rods which have threaded connections on each end which permit them to be connected to each other to form a drill string. The threaded connections are also used to attach a boring bit to the leading end of the drill string for rotation therewith. Preferably, a special tapered thread profile, similar to an oil field (API) thread, is used for improved joint strength and to speed making-up or breaking-out joints. The rods can be coupled or uncoupled in only three and one-half to four and one-half turns, about half that needed for straight threads.

After the borehole is dug, the drill string is retracted from the borehole. To facilitate installation of a utility service in the borehole, the utility lines to be installed may be connected to the drill string at its target end and pulled through the borehole as the drill string is retracted.

The general structure and operation of the preferred form of boring system 10 is fully described in U.S. Pat. No. 4,306,626. Boring system 10 includes a fixed frame assembly 16 which is positioned in launching pit P. A fluid cylinder 18 capable of exerting axial thrust in both a forward and reverse direction is fixed within frame assembly 16. The thrust cylinder is of double rod-end design. Therefore, its force capability pulling on the string of rods is the same as when pushing. In the preferred form of the invention, a hollow cylinder rod 20 is connected at one end to an axially moveable piston head of fluid thrust cylinder 18. Cylinder rod 20 is coaxially mounted around push rods 14. This allows thrust to be transmitted concentric with the push rods. The other end of cylinder rod 20 includes a reversible coupling assembly 22 for releasably coupling solid steel push rods 14 to the axially moveable cylinder rod 20.

Boring system 10 includes appropriate fluid lines 24 for supplying fluid to thrust cylinder 18 to move the axially moveable piston head of the thrust cylinder, and thus the cylinder rod 20, in either a forward or reverse direction, as desired.

The leading end 26 of drill string 12 includes a directional boring bit 28. Boring bit 28 may include an electronic transmitter or similar device for tracking its position and orientation. A surface receiver detects the signal of the transmitter and allows the operator to determine the position, depth and orientation of the boring bit. Boring bit 28 has a beveled face 30. When drill string 12 and boring bit 28 are simultaneously moved axially and rotated, boring bit 28 will drill in a substantially straight path. When drill string 12 and boring bit 28 are not rotated but moved axially, boring bit 28 will drill in a curved path.

Fluid thrust cylinder 18 is capable only of exerting an axial force on drill string 12 through cylinder rod 20 and coupling assembly 22 as its piston head moves axially back and forth. There are no means for supplying a rotative force necessary to provide directional control of the drill string.

In order to impart rotary motion to cylinder rod 20 and coupling assembly 22, and thereby to drill string 12, a rigid link 30 is attached between the linearly movable drill string and a fixed anchor point. Preferably, the moveable end of the link is fixed to the linearly moveable coupling assembly 22. The fixed end of the link is preferably connected to the stationary frame 16 of the rod pusher 10. As fluid cylinder 18 is stroked forward to advance the drill string 12, link 30 forces cylinder rod 20 and coupling assembly 22 to rotate clockwise as viewed looking down the borehole. The direction of rotation is chosen to be the same as that used to join together the threadably connected push rods 14 in order to preserve the integrity of the string.

In the preferred form of the invention, a bracket 32 is fixed to frame assembly 16 at the anchor point. A bolt 34 extends through a bushing assembly 40 in one end of link 30 to connect the fixed end of link 30 to the anchor point of bracket 32. The moveable end of link 30 is fixed to coupling assembly 22 by a pin 36 which extends through a similar bushing assembly 40. Pin 36 is threadably installed in a top surface of coupling assembly 22. A clip 39 serves to retain link 30 on pin 36. Of course, other equivalent structures for supporting both fluid cylinder 18 and link 30 may be used. For example, a trench box having front, rear and side walls constructed from tubular framed metal or wood sheets may be utilized in place of frame assembly 16. A truss frame having at least one side comprising a pair of spaced tubular members may be fixedly attached to the trench box, within the boundary defined by the walls. Cylinder 18 would be supported between the members, and the anchor point for rigid link 30 would be disposed on the truss frame. Any structure having sides could be used to support the fixed end of rigid link 30. Alternatively, rigid link 30 could be supported in a cantilever manner.

Figure 4:
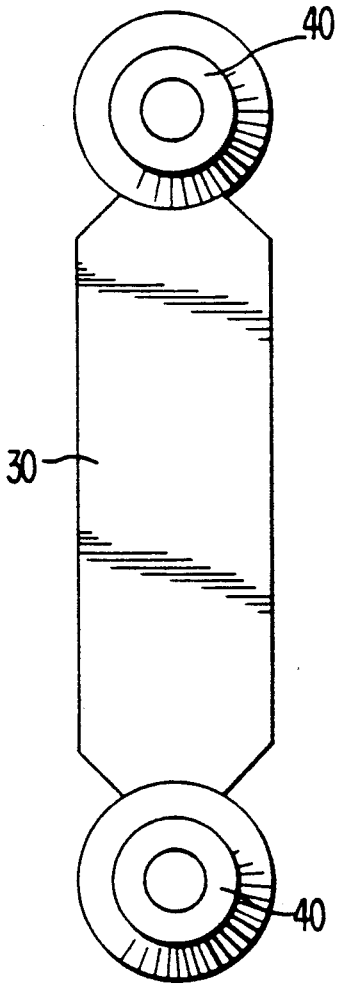
FIG. 4 is a top plan view of a conversion link according to a preferred form of the present invention.
Figure 5:
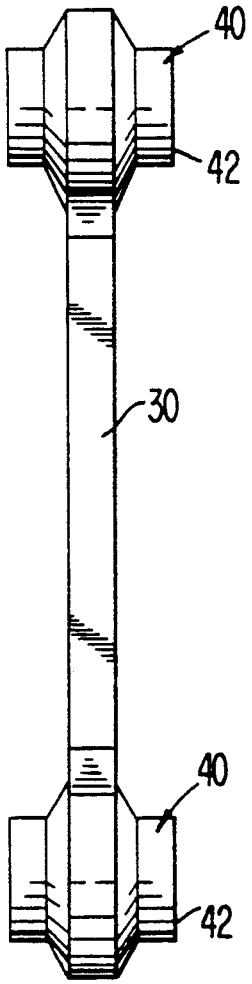
FIG. 5 is a side plan view of the conversion link shown in FIG. 4.

As shown in FIGS. 4 and 5, link 30 includes a ball joint-type bushing assembly 40 at each of its ends. These bushing assemblies include a center bush 42 which is free to rotate about its central axis.

Figure 6:
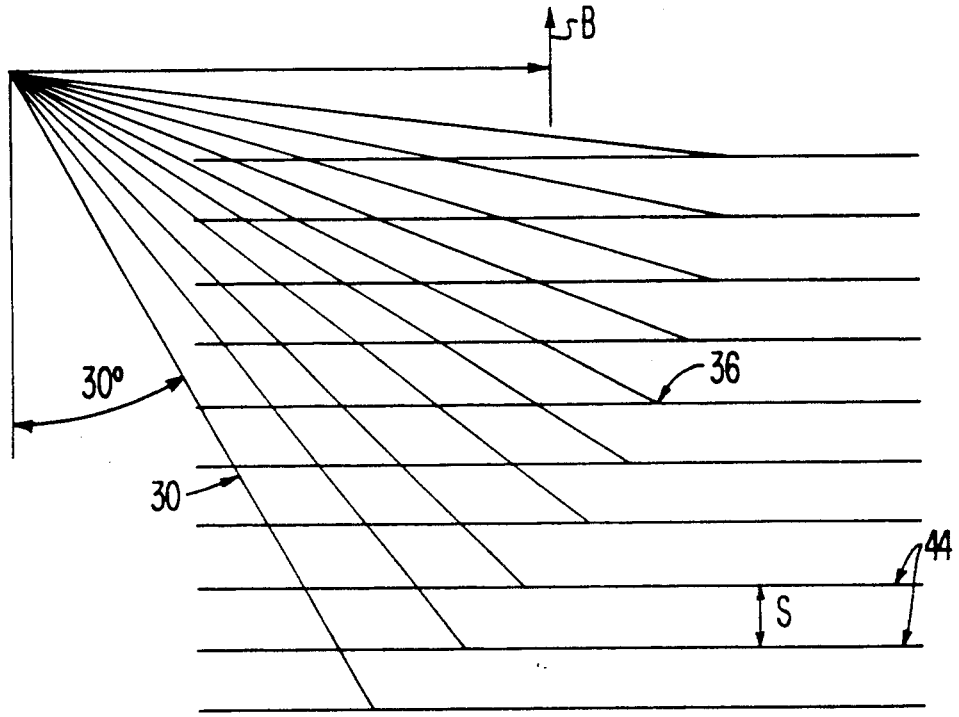
FIG. 6 is a top view of a geometric representation of the path of travel of the conversion link of the present invention when the conversion link is fixed in place.
Figure 7:
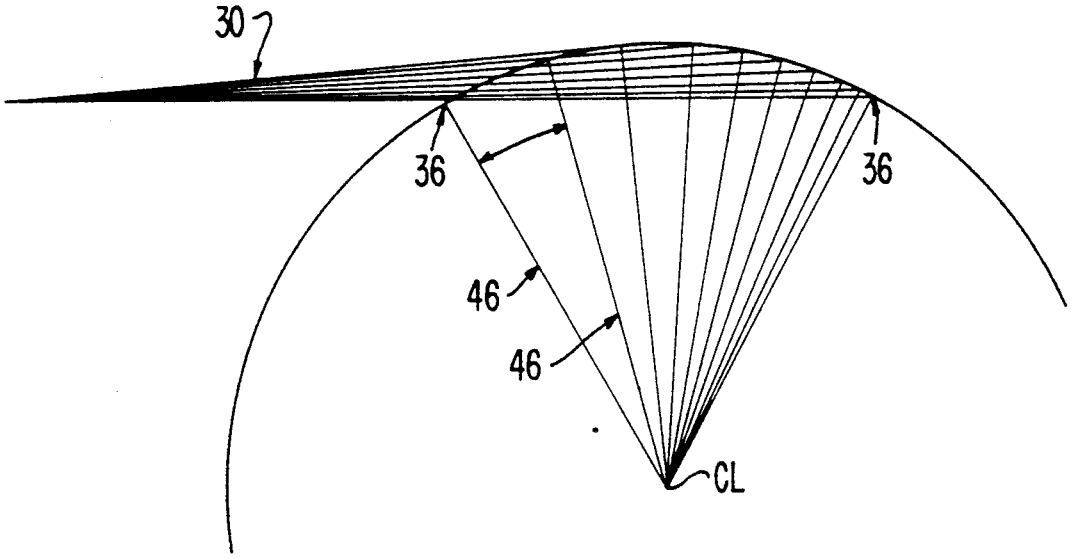
FIG. 7 is a front view of a geometric representation of the path of travel of the conversion link shown in FIG. 6.
Figure 8:
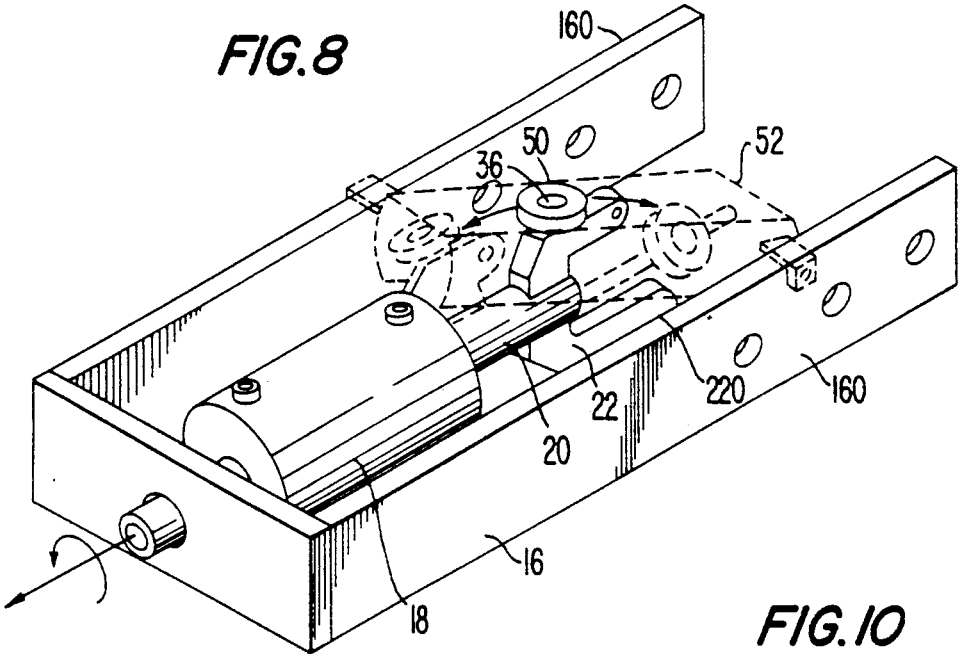
FIG. 8 is a perspective view of a thrust cylinder and coupling assembly including a conversion device according to a second embodiment of the invention.

The rotary motion effected per inch of cylinder travel is depicted in FIGS. 6 and 7. In the preferred form of the invention, approximately 60 degrees of rotation occurs with every complete stroke of thrust cylinder 18.

As shown in FIGS. 6 and 7 there is a greater degree of rotation in the beginning of each cylinder stroke than at the end of the stroke. Thus, a higher rate of rotation per unit distance bored is possible by short cycling the cylinder.

In FIGS. 6 and 7 fixed bracket 32, link 30, and pin 36 are shown schematically. Arrow B corresponds to the direction of the forward travel of drill string 12. As shown in FIGS. 6 and 7, at the starting point of each forward cycle of fluid thrust cylinder 18, the moveable end of link 30 is off-center from the axial centerline CL of the borehole. Preferably, the starting point is as far counterclockwise as possible and the ending point is as far clockwise as possible. This allows the maximum amount of rotation per cycle without interfering with the structure of the rod pusher. Thus, in a preferred form of the invention, the path of pin 36 during each forward cycle is preferably from a position of $-30°$ to $+30°$ from the centerline of the borehole, as shown in FIG. 7.

Spaces S between each horizontal line 44 in FIG. 6 corresponds to approximately one inch of forward travel of drill string 12, using a preferred stroke of nine inches. The spaces between each radial line 46 in FIG. 7 also corresponds to approximately one inch of forward travel. The change in angular position of pin 36 is clearly greater during the beginning of each cycle than at the end of the cycle. By way of example, if link 30 is approximately 12 inches long, and if each forward cycle stroke of thrust cylinder 18 is approximately nine inches, and if bracket 32 is approximately five inches from the axial centerline of the borehole, then the change in angle with respect to the axial centerline of pin 36 will be approximately 15° during the first inch of axial movement, but only approximately 2° during the last inch of axial travel.

Once cylinder 18 has been fully stroked forward, the operator reverses its control valve to retract cylinder rod 20 for another pushing increment. The rod pusher cylinder is preferably cycled back and forth by a control valve in the hydraulic circuit. An electric solenoid valve is preferred over a manual control valve on longer bores for improved productivity.

Coupling assembly 22 is released from drill string 12 during the reverse movement of the cylinder rod 20 so that the string remains stationary in the borehole. During this reverse portion of the cycle, link 30 causes cylinder rod 20 and coupling assembly 22 to rotate counterclockwise back to their original starting position. This cycle is repeated as long as a straight bore is desired.

When steering corrections are necessary, the boring bit 28 is rotated so that beveled face 30 is in the proper orientation. This may be done by "short cycling" the stroke, if necessary, to cause faster rotation of the drill bit and drill string. Link 30 is then removed from coupling assembly 22 by removing clip 39. Link 30 may be stowed along the frame assembly. The operator then continues to advance the string of rods without rotation until another steering correction is desired.

Figure 2:
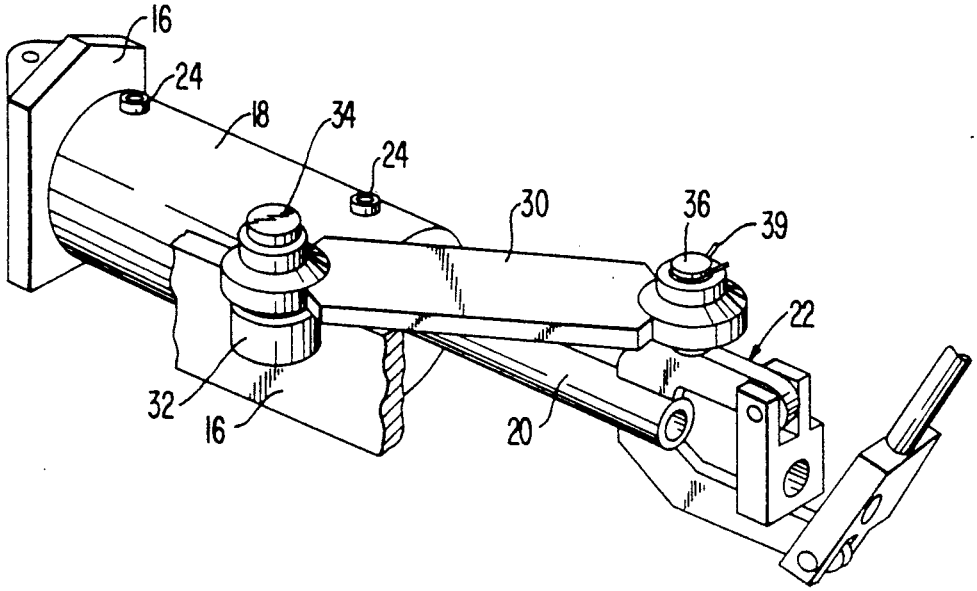
FIG. 2 is a perspective view of a thrust cylinder and coupling assembly including a conversion device according to a first embodiment of the invention.
Figure 3:
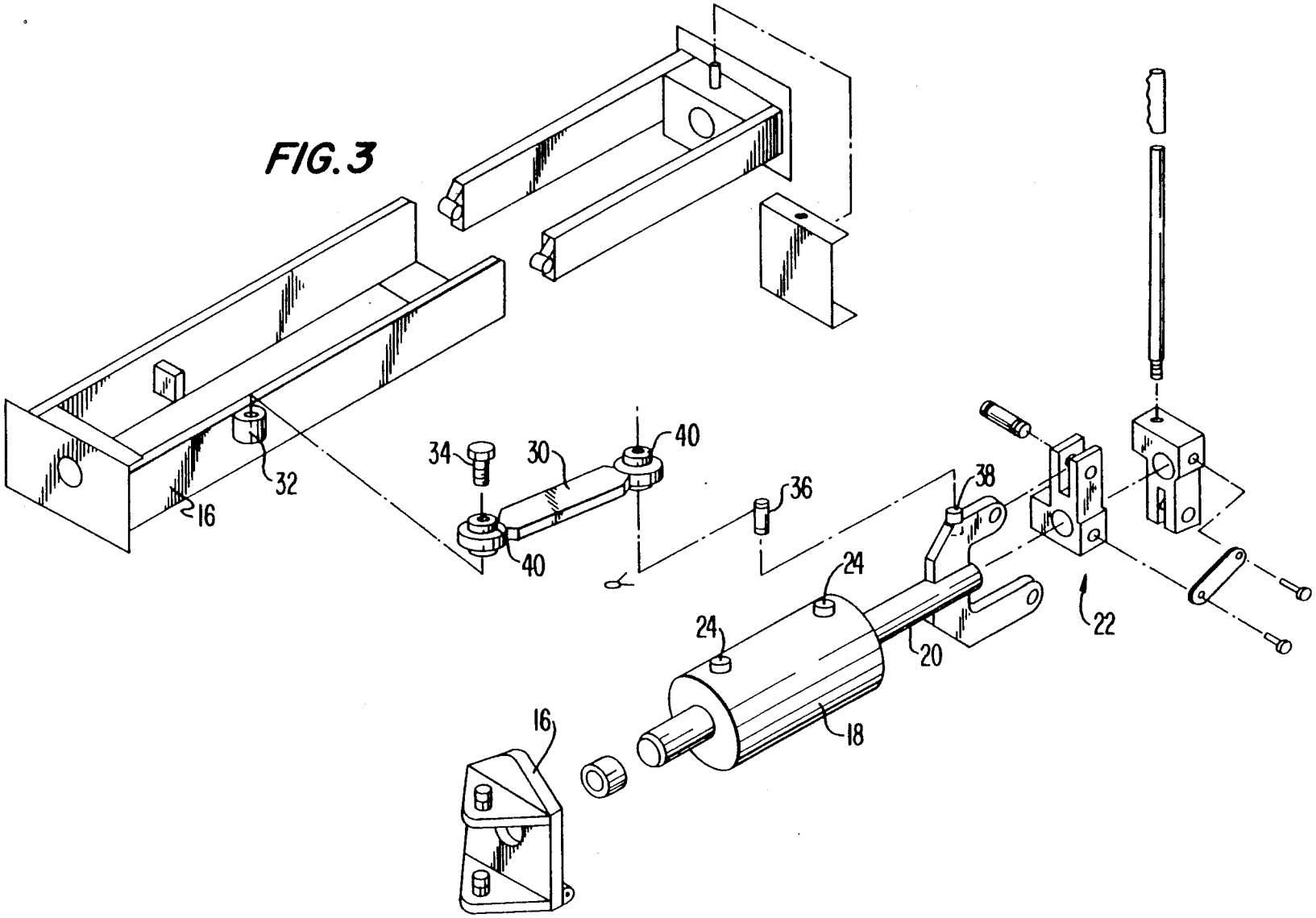
FIG. 3 is an exploded perspective view of a push rod assembly according to a preferred form of the present invention.

With reference to FIGS. 8–11, a second embodiment of a mechanism for converting axial motion of cylinder rod 20 and coupling assembly 22 into both axial and rotational motion, is disclosed. Cam follower 50 is removably disposed on C-shaped portion 220 of coupling assembly 22, at the top portion thereof, as shown, when coupling assembly 22 is at a midway point through a rotational cycle. For the sake of clarity, the remaining elements of coupling assembly 22 are not shown in FIGS. 8–11, but would be identical to the same elements as shown in FIG. 2. Cam follower 50 may be spherical roller removably attached on a pin such as pin 36. Guide assembly 52 is removably attached transversely between side walls 160 of frame 16. As shown, guide assembly 52 may have an overall generally rectangularly shape with a flat top surface, an open bottom surface, and curved side surfaces. Guide assembly 52 thus includes a hollow pathway PW formed therein and extending from an open forward end to a closed rear end.

Guide assembly 52 also includes tab portions 55 extending laterally outwardly from each of the side surfaces. One of tabs 55 is disposed near the closed end of guide assembly 52 and the other is disposed near the open end. Guide assembly 52 may be fixedly and removably attached on side walls 160 at tabs 55 which are disposed over side walls 160 and held in place by any suitable means, for example, screws 57 as shown, or any other equivalent, well-known and commonly used quick-release fastener. Screws 57 may be removed to allow removal of guide assembly 52. Guide assembly 52 is disposed transversely across the region between side walls 160. Other equivalent structures which include the pathway may also be utilized. Although guide assembly 52 is shown as attached at the top of side walls 160, it may be attached at the bottom as well. In this situation, cam follower 50 is removably disposed on the bottom portion of C-shaped portion 220 of coupling assembly 22. In addition, guide assembly may be fixedly and removably attached on one of the tubular members of the side walls of a trench box as discussed above with respect to the first embodiment.

Figure 10:
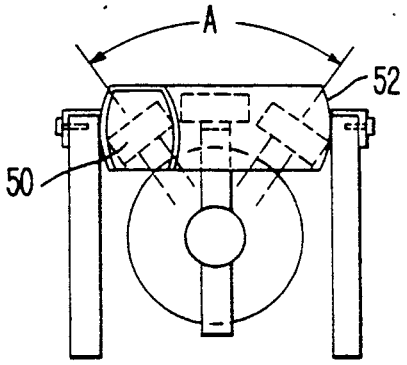
FIG. 10 is front view of the embodiment shown in FIG. 8.
Figure 9:
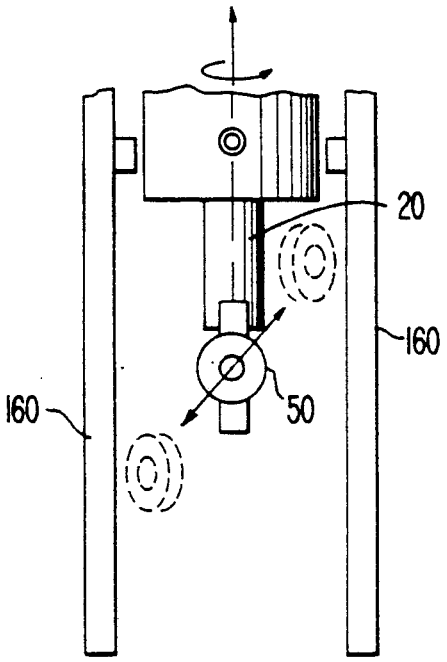
FIG. 9 is an overhead view of the embodiment shown in FIG. 8.
Figure 11:
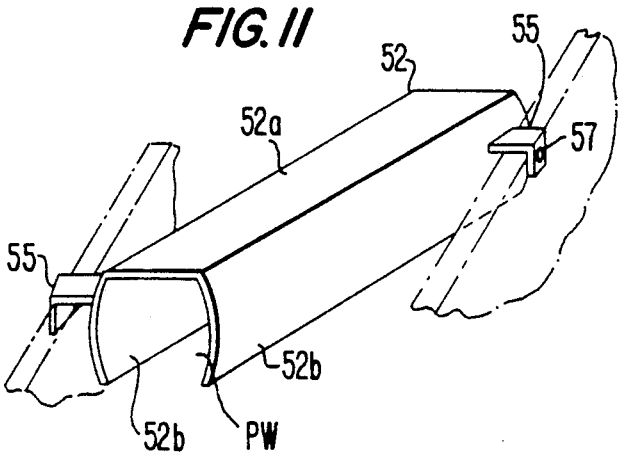
FIG. 11 is a close-up perspective view of the conversion device shown in the embodiment of FIG. 8.

In operation, if it is desired to cause rotational motion of the drill string simultaneously with axial motion, coupling assembly 22 is moved to a position forward of guide assembly 52, and cam follower 50 is disposed on pin 36. Guide assembly 52 is inserted between and secured to the side walls 160. Thereafter, when coupling assembly 22 is displaced axially rearwardly due to axial motion of cylinder rod 20, spherical roller 50 enters into the interior region of guide assembly 52 through the front open end and immediately contacts the inner surface of the side wall. Therefore, as shown in FIGS. 9 and 10, roller 50 rolls along the inner surface of guide assembly 52 due to the contact therebetween, and is forced to traverse along hollow pathway PW from a position near one of side walls 160 to a position near the other of side walls 160. Thus, roller 50 follows a rotational path about the longitudinal axis of the push rod, as well as an axial path. The rotational movement of roller 50 forces coupling assembly 22 to rotate as well, simultaneously with either the forward or rearward axial movement, and further causing the drill string to undergo rotational motion. When it is not desired for the drill string to undergo rotational motion, screws 57 are removed, and guide assembly 52 is simply lifted off of side walls 160.

Figure 12:
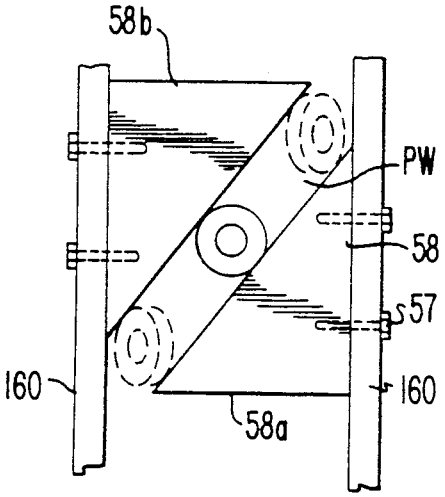
FIG. 12 is an overhead view of a conversion device according to a third embodiment of the invention.

With reference to FIG. 12, a third embodiment of a mechanism for converting axial motion of cylinder rod 20 and coupling assembly 22 into both axial and rotational motion, is disclosed. The third embodiment is similar to the second embodiment in that guide assembly 52 is replaced by guide assembly 58 including left and right wedge-shaped plates **58*a* and 58*b* which are fixedly but removably disposed on the inner surfaces of side walls 160 by any suitable means, for example, screw 57 disposed in appropriate holes, or any other equivalent means. The inner surface of each of wedge-shaped plates 58*a* and 58*b* is formed such that when the two plates are disposed in place between side walls 160, a constant width gap G is formed therebetween. Gap G serves the same function as pathway PW formed in guide assembly 52 of the second embodiment. The operation of the apparatus is identical with the operation for the second embodiment. However, when it is not desired for the drill string to undergo rotational motion, cam follower 50** may be removed.

Figure 13:
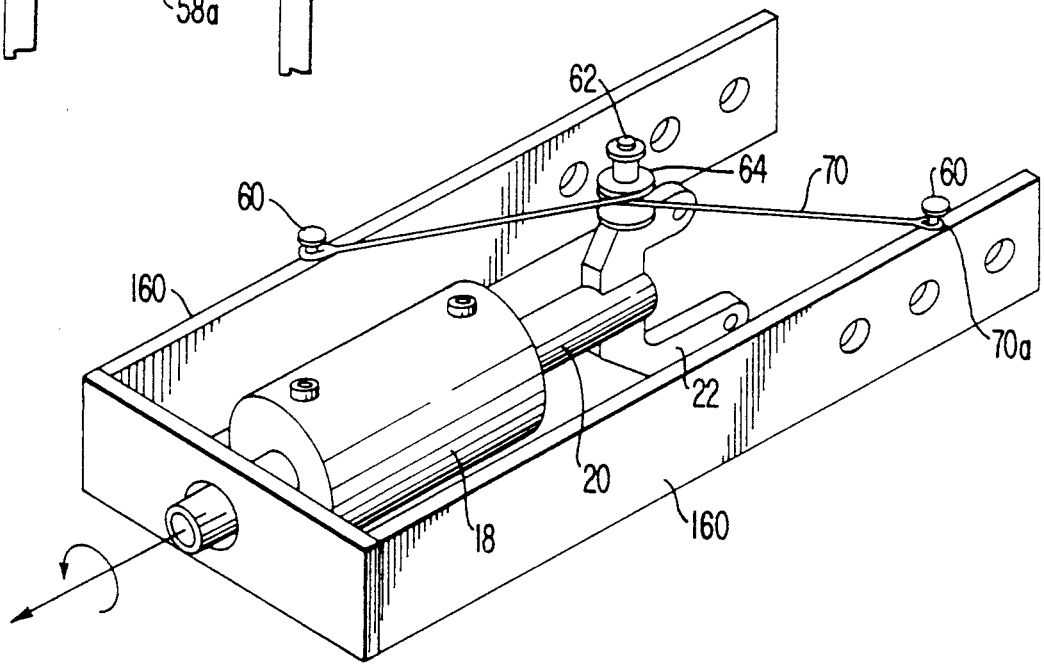
FIG. 13 is a perspective view of a thrust cylinder and coupling assembly including a conversion device according to a fourth embodiment of the invention.
Figure 14:
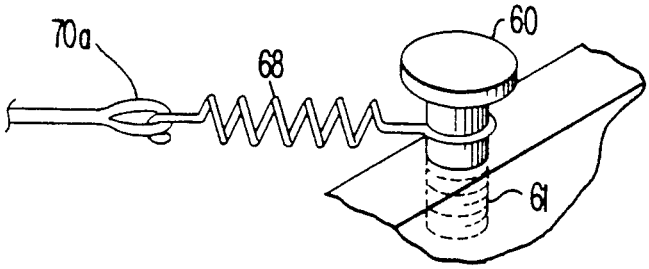
FIG. 14 is a close-up view of a portion of the device shown in FIG. 13.

With reference to FIGS. 13–14, a fourth embodiment of a mechanism for converting axial motion of cylinder rod 20 and coupling assembly 22 into both axial and rotational motion, is disclosed. In the fourth embodiment, mounting pin 62 includes a top overhanging portion and is fixedly but removably disposed on the top of C-shaped portion 220 of coupling assembly 22. Capstan pulley 64 is shorter than pin 62 and is disposed about pin 62 such that a gap remains between the top of pin 62 and the top of pulley 64. Thus, capstan pulley 64 is freely movable in the vertical direction along pin 62 for the extent of the gap. First and second cable anchors 60 are fixedly but removably disposed on opposite walls 160. For example, cable anchors 60 may have screw-threaded portions which may be screwed in holes formed in side walls 160. Cable anchors 60 are displaced from each other in the axial direction such that when the C-shaped portion of coupling assembly 22 is rotated such that pin 62 is in its top-most or overhead position, pin 62 and anchors 60 are disposed in a generally linear path which extends transversely to side walls 160. Additionally, the axial displacement of anchors 60 is greater than the maximum possible extent of the axial movement of coupling assembly 22 and cylinder rod 20. Continuous cable 70 is coupled at each end to cable anchors 60, for example, by looped ends **70*a* which are disposed about the anchors. Cable 70 is also wrapped about capstan pulley 64**.

In operation, as coupling mechanism 22 moves in the axial direction, the action of cable 70 forces pulley 64 and thus coupling mechanism 22 to undergo simulataneous rotational motion since the pulley is constrained by cable 70 as it moves axially forwardly or rearwardly. Since pulley 64 does not travel along a perfectly linear path between the anchor points, the effective length of the cable should be made continually adjustable. The necessary adjustment is partially provided by the fact that pulley 64 is free to move in the vertical direction. Additionally, as shown, in FIG. 14, the effective cable length may be made adjustable as necessary by disposing coil spring 62 between one end of cable 70 and one cable anchor 60. Coil spring 62 includes two hooked ends, one end fitting through looped end **70*a* of cable 70 and the other hooked end fitting about anchor 60. Coil spring 62 expands or contracts as necessary to adjust the effective cable length. When it is not desired to provide rotational motion to the coupling mechanism, cable 70** is simply removed.

Figure 15:
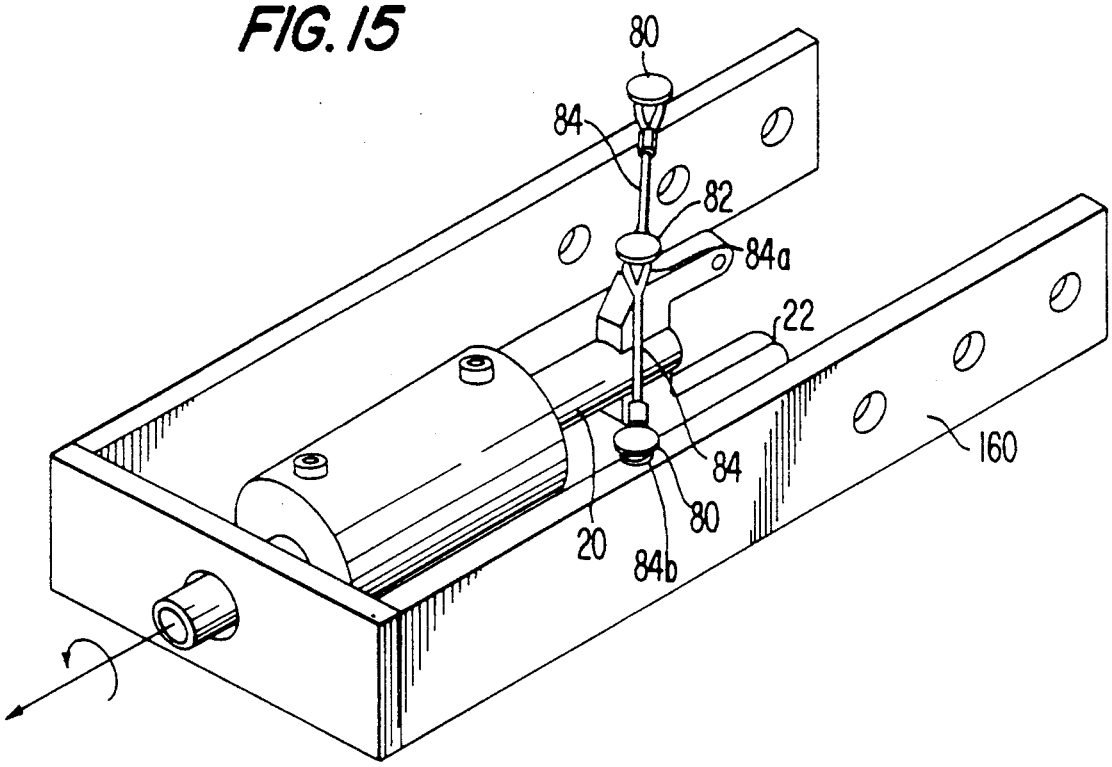
FIG. 15 is a perspective view of a thrust cylinder and coupling assembly including a conversion device according to a fifth embodiment of the invention.
Figure 16:
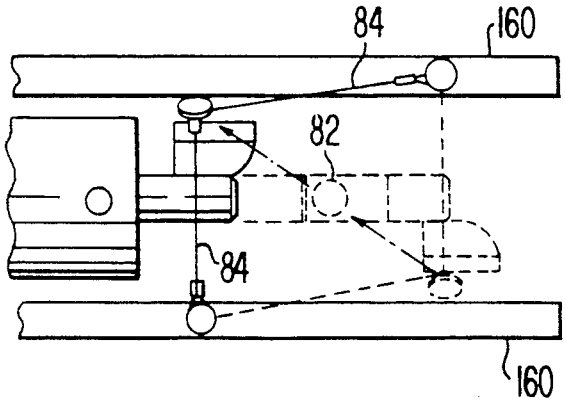
FIG. 16 is an overhead view of the embodiment shown in FIG. 15.

With reference to FIGS. 15–16, a fifth embodiment of a mechanism for converting axial motion of cylinder rod 20 and coupling assembly 22 into both axial and rotational motion, is disclosed. In the fifth embodiment, cable anchors 80 are provided at locations similar to the locations of cable anchors 60 in the fourth embodiment. However, two distinct cables 84 are provided, and each cable 84 is connected at one end to one cable anchor 80, for example, cables 84 may have looped ends which are disposed about the anchors. The other ends of cables 84 may also be looped about center pin 82. As in the previous embodiment, as coupling mechanism 22 moves in the axial direction, the constraining action of cables 84 forces pin 82 and thus coupling mechanism 22 to undergo rotational motion simultaneously with the forward or rearward axial motion. When it is not desired to provide rotational motion to coupling mechanism 22, cables 84 are simply removed by first removing anchors 80, or pin 82 may be removed. As with the fourth embodiment, a continuous adjustment provision may be necessary, although in the fifth embodiment the adjustment feature would be provided to account for production tolerances and cable stretch from use. The adjustment provision may include, for example, two coil springs 68, with one disposed between each cable 84 and each cable anchor 80.

Although several preferred embodiments of the invention have been shown and described, the invention is not intended to be limited thereto. Various modifications will be readily apparent to those of ordinary skill in this technology, and the invention is to be limited only by the following claims.

We Claim:

1. In a device for forming a borehole through the earth by pushing a push rod having a directional boring head mounted on one end forwardly through the earth, the device comprising a thrust means for exerting an axial force on the push rod, and coupling means for coupling the thrust means to the push rod to provide axial propulsion to the push rod, the coupling means moving axially with the thrust means, the improvement comprising:

conversion means for converting the axial movement of the push rod into combined axial and rotational movement, said conversion means comprising a fixed frame assembly including a pair of sides disposed laterally of both the coupling means and the thrust means, a cam follower disposed on the coupling means, and a guide means for guiding said cam follower to move in a rotational path about the axis of the push rod during axial motion, said guide means disposed between said sides.

2. The improvement recited in claim 1, said guide means removably attached between said sides.

3. The improvement recited in claim 2, said guide means including a hollow interior pathway through which said cam follower moves during axial movement of the coupling means.

4. The improvement recited in claim 1, said guide means comprising a first and a second wedge disposed opposite each other on the inner surfaces of said sides, said wedges shaped so as to form a pathway therebetween, said cam follower moving through said pathway during axial motion of the coupling means.

5. The improvement recited in claim 1, said guide means comprising an integrally formed guide having an open bottom surface and a hollow interior region, said cam follower moving through said pathway during axial motion of the coupling means.

6. The improvement recited in claim 1, said guide means comprising a first and a second wedge disposed opposite each other on the inner surfaces of said sides, said wedges shaped so as to form a pathway therebetween, said cam follower moving through said pathway during axial motion of the coupling means.

7. The improvement recited in claim 1, said cam follower comprising a spherical roller.

8. The improvement recited in claim 1, the thrust means comprising a fluid cylinder and a cylinder rod extending from and reciprocated by said cylinder, the coupling means disposed at the end of the cylinder rod which extends from the cylinder, the push rod disposed through both the cylinder rod and the coupling means, the coupling means movable from a position in which it engages the push rod to a position in which it is disengaged from the push rod.

9. A device for forming a borehole through the earth by pushing a push rod forwardly through the earth, said device comprising:

thrust means for exerting an axial force on the push rod;

coupling means for coupling said thrust means to the push rod to provide axial propulsion to the push rod, said coupling means moving axially with said thrust means;

a fixed frame assembly including a pair of sides disposed laterally of both said coupling means and said thrust means;

a cam follower disposed on said coupling means; and guide means for guiding said cam follower to move in a rotational path about the axis of the push rod during axial movement, said guide means defining a pathway through which said cam follower moves during axial movement of the coupling means.

10. The device recited in claim 9, said guide means removably attachable between said sides, said thrust means comprising a fluid cylinder and a cylinder rod extending from and reciprocated by said cylinder, said coupling means disposed at the end of said cylinder rod which extends from said cylinder, said push rod disposed through both said cylinder rod and said coupling means, said coupling means movable from a position in which it engages the push rod to a position in which it is disengaged from the push rod.

11. In a device for forming a borehole through the earth by pushing a push rod having a directional boring head mounted on one end forwardly through the earth, the device comprising a thrust means for exerting an axial force on the push rod, and coupling means for coupling the thrust means to the push rod to provide axial propulsion to the push rod, the coupling means moving axially with said thrust means, the improvement comprising:

a fixed frame assembly including a pair of sides disposed laterally of both the coupling means and the thrust means, and cable means connected at one end to a first location on the first of said sides and at the opposite end to a second location on the second of said sides, said cable means coupled at an intermediate location to the coupling means, said cable means for converting the axial movement of the coupling means into combined axial and rotational movement such that the push rod undergoes combined axial and rotational movement.

12. The improvement recited in claim 11, said cable means comprising a single cable, said single cable removably connected at the first and second locations.

13. The improvement recited in claim 12 further comprising a pulley disposed on said coupling means, said single cable looped about said pulley.

14. The improvement recited in claim 13 further comprising a mounting pin disposed on said coupling means, said pulley comprising a capstan pulley removably disposed about said mounting pin so as to be movable for a limited extent in the vertical direction.

15. The improvement recited in claim 14 further comprising first and second cable anchors removably attached at the first and second locations, the first location displaced in the axial direction from the second location such that when the coupling means is rotated to a position in which said pulley is located at the top of the coupling means, said pulley and said anchors are disposed in a generally linear path which extends transversely to said sides.

16. The improvement recited in claim 12 further comprising an adjustment means connecting said single cable at said one end to one of said sides, said adjustment means for continually adjusting the length of said cable during axial motion of the coupling means.

17. The improvement recited in claim 16, said adjusting means comprising a coil spring disposed between said one end of said cable and one of said sides.

18. The improvement recited in claim 11 further comprising adjusting means connecting said cable means at said one end to one of said sides, said adjusting means for continually adjusting the effective length of said cable means during axial motion of the coupling means.

19. The improvement recited in claim 18, said adjusting means comprising a coil spring linking said one end of said cable means and one of said sides.

20. The improvement recited in claim 11, said cable means comprising a first and a second cable, each said cable removably connected at one end to one of the first and second locations and at the opposite end to the coupling means.

21. The improvement recited in claim 20 further comprising a center pin removably fixed on the coupling means, said first and second cables each connected at said opposite ends thereof to said center pin.

22. The improvement recited in claim 21 further comprising first and second cable anchors removably attached at the first and second locations, the first location displaced in the axial direction from the second location such that when the coupling means is rotated to a position in which said center pin is located at the top of the coupling means, said center pin and said anchors are disposed in a generally linear path which extends transversely to said sides.

23. The improvement recited in claim 20 further comprising adjusting means connecting said first and second cables at said one end to one of said sides, said adjusting means for continually adjusting the effective length of each said cable during axial motion of the coupling means.

24. The improvement recited in claim 23, said adjusting means comprising a coil spring linking said one end of each said cable and one of said sides.

25. A device for forming a borehole through the earth by pushing a push rod forwardly through the earth, said device comprising:

thrust means for exerting an axial force on the push rod;

coupling means for coupling said thrust means to the push rod to provide axial propulsion to the push rod, said coupling means moving axially with said thrust means a fixed frame assembly including a pair of sides disposed laterally of both said coupling means and said thrust means; and cable means connected at one end to a first location on the first of said sides and at the opposite end to a second location on the second of said sides, said cable means coupled at an intermediate location to said coupling means, said cable means for converting the axial movement of said coupling means into combined axial and rotational movement such that the push rod undergoes combined axial and rotational movement as well.

26. The device recited in claim 25, said cable means comprising a single cable, said single cable removably connected at the first and second locations.

27. The device recited in claim 26 further comprising a pulley removably disposed on said coupling means, said single cable looped about said pulley.

28. The device recited in claim 25, said cable means comprising a first and a second cable, each said cable removably connected at one end to one of the first and second locations and at the opposite end to the coupling means.

29. The device recited in claim 25, said thrust means comprising a fluid cylinder and a cylinder rod extending from and reciprocated by said cylinder, said coupling means disposed at the end of said cylinder rod which extends from said cylinder, the push rod disposed through both said cylinder rod and said coupling means, said coupling means movable from a position in which it engages said push rod to a position in which it is disengaged from said push rod.

30. In a device for forming a borehole through the earth by pushing a push rod having a directional boring head mounted on one end forwardly through the earth, the device comprising a thrust means for exerting an axial force on the push rod, and coupling means for coupling the thrust means to the push rod to provide axial propulsion to the push rod, the coupling means moving axially with the thrust means, the improvement comprising:

conversion means for converting the axial movement of the push rod into combined axial and rotational movement, said conversion means comprising a fixed frame assembly, a cam follower disposed on the coupling means, and a guide means for guiding said cam follower to move in a rotational path about the axis of the push rod during axial motion.

31. The device recited in claim 30, said guide means removably attached to said fixed frame assembly.

32. A device for forming a borehole through the earth by pushing a push rod forwardly through the earth, said device comprising:

thrust means for exerting an axial force on the push rod;

coupling means for coupling said thrust means to the push rod to provide axial propulsion to the push rod, said coupling means moving axially with said thrust means a fixed frame assembly;

a cam follower disposed on said coupling means; and guide means for guiding said cam follower to move in a rotational path about the axis of the push rod during axial movement, said guide means defining a pathway through which said cam follower moves during axial movement of the coupling means.

33. The device recited in claim 32, said guide means removably attachable to said fixed frame assembly.

* * * * *

UNITED STATES PATENT AND TRADEMARK OFFICE

CERTIFICATE OF CORRECTION

PATENT NO. : 5,070,948

DATED : December 10, 1991

INVENTOR(S) : G. Edwin Malzahn and Kenneth W. Schuermann

It is certified that error appears in the above-identified patent and that said Letters Patent is hereby corrected as shown below:

On the title page, in section [56], "References Cited", under "U.S. PATENT DOCUMENTS" please insert:

--4,953,638 9/1990 Dunn--.

On the title page, in section [56], "References Cited", under "OTHER PUBLICATIONS" please insert:

--The publication entitled "True Trac Extended-Range Guided Boring System" dated July 1989, by the Charles Machine Works.--.

Signed and Sealed this

Fourth Day of May, 1993

*Attest:*

Michael K. Kirk

MICHAEL K. KIRK

*Attesting Officer*

*Acting Commissioner of Patents and Trademarks*